US010531758B2

(12) United States Patent
Frett

(10) Patent No.: US 10,531,758 B2
(45) Date of Patent: Jan. 14, 2020

(54) CURTAIN ROD ASSEMBLY

(71) Applicant: Jeremiah Frett, Tortola (VG)

(72) Inventor: Jeremiah Frett, Tortola (VG)

( * ) Notice: Subject to any disclaimer, the term of this patent is extended or adjusted under 35 U.S.C. 154(b) by 311 days.

(21) Appl. No.: 15/472,868

(22) Filed: Mar. 29, 2017

(65) Prior Publication Data

US 2017/0280909 A1 Oct. 5, 2017

Related U.S. Application Data

(60) Provisional application No. 62/315,185, filed on Mar. 30, 2016.

(51) Int. Cl.

| | |
|---|---|
| ***A47H 1/10*** | (2006.01) |
| ***A47H 1/02*** | (2006.01) |
| ***A47H 1/102*** | (2006.01) |
| *A47H 1/14* | (2006.01) |
| *A47H 1/00* | (2006.01) |

(52) U.S. Cl.

CPC ..... *A47H 1/02* (2013.01); *A47H 1/10* (2013.01); *A47H 1/14* (2013.01); *A47H 2001/006* (2013.01); *A47H 2001/0215* (2013.01)

(58) Field of Classification Search

CPC ..... A47H 2001/006; A47H 1/02; A47H 2001/0215; A47H 2001/003; A47H 1/10; A47H 1/102; A47H 1/14; A47H 1/142; A47H 1/022; A47H 2001/0205; A47H 3/38; A47H 10/10; A47K 10/04; A47K 10/08

See application file for complete search history.

(56) References Cited

U.S. PATENT DOCUMENTS

| | | | | |
|---|---|---|---|---|
| 1,434,384 | A * | 11/1922 | Hed | F16H 61/0293 74/334 |
| 3,951,269 | A * | 4/1976 | Anderson | A47H 1/102 211/105.4 |
| 5,022,104 | A * | 6/1991 | Miller | A47K 3/38 160/330 |
| 5,642,595 | A | 7/1997 | Daniels et al. | |
| 6,694,543 | B2 * | 2/2004 | Moore | A47H 1/022 248/261 |
| 8,215,501 | B2 * | 7/2012 | Trettin | A47K 3/38 211/105.2 |
| 8,505,129 | B2 | 8/2013 | Parker et al. | |
| 9,554,674 | B2 * | 1/2017 | Forrest | A47K 3/38 |
| 10,051,985 | B2 * | 8/2018 | Jones | A47K 3/38 |
| 2004/0117945 | A1 * | 6/2004 | Huang | A47H 1/14 16/102 |
| 2005/0028945 | A1 | 2/2005 | Hsu | |
| 2007/0170134 | A1 | 7/2007 | Bishop et al. | |
| 2011/0030906 | A1 | 2/2011 | Trettin et al. | |

* cited by examiner

*Primary Examiner* — Phi D A

(74) *Attorney, Agent, or Firm* — Miles & Stockbridge P.C.

(57) ABSTRACT

An improved curtain rod assembly is provided that obviates limitations and problems with conventional assemblies. In particular, the improved curtain rod assembly utilizes complementary locking and key components which allow for a secure, robust, and reversible connection between a curtain rod and an associated finial. As such, assembling the curtain rod assembly does not require the use of screws, nails, or other items which may permanently damage the curtain rod assembly, limit the longevity or usefulness of the curtain rod assembly, or present a danger to the user.

11 Claims, 8 Drawing Sheets

CURTAIN ROD ASSEMBLY

CROSS-REFERENCE TO RELATED APPLICATIONS

This application claims benefit of priority of U.S. Provisional Patent Application 62/315,185, entitled, "Curtain Rod Assembly," which was filed Mar. 30, 2016. The entire contents and disclosures of this patent application is incorporated herein by reference in its entirety.

FIELD OF INVENTION

The embodiments of the present invention relate generally to improvements in technology related to assembly hardware, and more particularly, to assembly hardware for assembling curtain rods with finials, which may be decorative or ornamental in nature. In addition, embodiments of the present invention are directed to an improved curtain rod assembly, and more importantly, to an improved curtain rod assembly that substantially obviates one or more problems due to limitations and disadvantages of the related art.

BACKGROUND OF THE INVENTION

In a number of technical areas, product assembly is not performed until an end user has purchased and taken home a number of discrete parts. In some fields, the end product is designed to be aesthetically pleasing, while in other fields, the end product is required to be load-bearing after assembly. In some cases, the end product is required to have both aesthetic and load-bearing qualities.

One such end product is an assembled curtain rod system. Curtains are generally a cloth or other material designed to function as a barrier, such as a drape or a shower curtain. The barrier may be designed to obscure light, water, or airflow. The curtain is generally hung from a rod, with the rod being hung from or attached to a wall or other surface. To successfully hang a curtain, a curtain rod assembly comprising several pieces may be utilized.

Conventional curtain rod assemblies may be cumbersome to install. Conventional curtain rod assemblies are not particularly robust or reliable, causing frustration for the end-user, who may be tasked with reassembling the curtain rod assembly or rehanging the curtain rod after each reassembly and reinstallation.

As part of a curtain rod assembly, curtain rod finials may be attached to the ends of the curtain rod, which may function as decorative end caps for the curtain rod. Among the frustrations experienced by the end-user is the frequent falling of curtain rod finials to the ground. For example, a curtain rod finial is often loosely fastened to the curtain rod, which may be accomplished simply by pushing the finial into or onto the curtain rod, with the rod being hollow or solid. In another example, the finial may be connected to the curtain rod using screws and holes that, over time, become unusable or dysfunctional as a result of repeated screwing and unscrewing or deterioration of the constituent parts or materials. For example, the threads of the screws and holes may become worn and no longer provide a good hold for the finial to remain installed with the curtain rod. Additionally, screws may be arranged such that a pointed or other end of a screw may be exposed within or external to the finial or the rod, which poses a hazard to both the end-user and especially to any children which may be present. Furthermore, if the finial disassociates from the rod, the end-user may have to dodge falling debris in the form of the finial or associated parts to avoid injury.

Accordingly, the embodiments of the present invention are directed to systems and methods that integrate improved curtain rod assembly components that substantially obviate one or more problems due to limitations and disadvantages of related art.

SUMMARY OF THE INVENTION

Systems and methods are provided to assist with creating a secure, robust, and reliable curtain rod assembly. The curtain rod assembly focuses on providing a simple, easy to use system of complementary components which provide a locking mechanism between the curtain rod and, e.g., an associated finial. Additional features and advantages of the invention will be set forth in the description which follows, and in part will be apparent from the description, or may be learned by practice of the invention. The objectives and other advantages of the invention will be realized and attained by the structure and particularly pointed out in the written description and claims hereof as well as the appended drawings.

To achieve these and other advantages and in accordance with the purpose of the present invention, as embodied and broadly described, the improved curtain rod assembly includes a system for assembling the curtain rod assembly utilizing complementary locking and key components which allow for a secure, robust, and reversible connection between a curtain rod and an associated finial.

Further, additional advantages may be provided by allowing for a variety of finial designs to be added and removed from a curtain rod without damaging the curtain rod or finial with hardware as is required by conventional systems of curtain rod assemblies.

BRIEF DESCRIPTION OF THE DRAWINGS

The accompanying drawings, which are incorporated herein and constitute part of this specification, illustrate exemplary embodiments of the invention, and, together with the general description given above and the detailed description given below, serve to explain the features of the invention.

Figure 1:
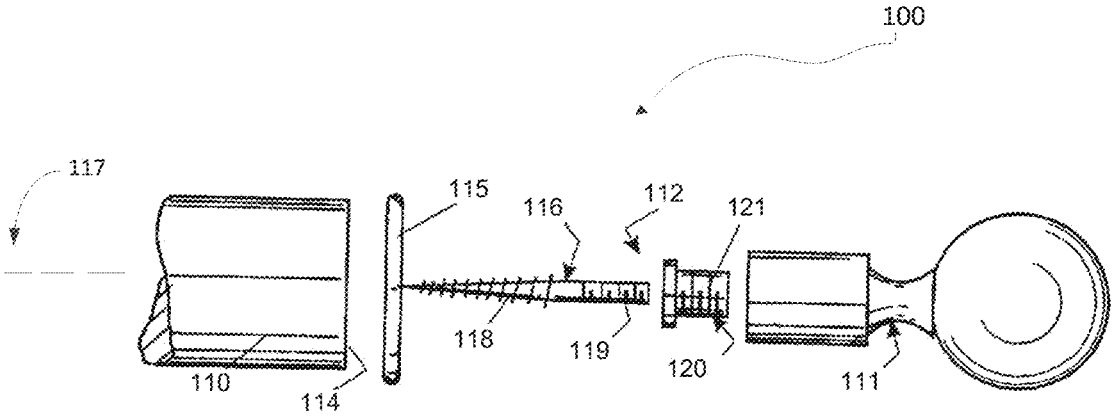
FIG. 1 (Prior Art)
FIG. 1 illustrates an example of a conventional curtain rod assembly.

According to the various embodiments, the curtain rod assembly and constituent parts, which may include a curtain rod, curtain rod cap, tension ring, finial, and other components may be made of a variety of suitable materials, including, e.g., wood, plastic, composite, various metals and alloys, etc. In addition, the curtain rod assembly described herein in various embodiments may be arranged as numerous shapes and sizes depending on the intended application, e.g., size of shape of a window, curtain weight, etc.

DETAILED DESCRIPTION

Definitions

Where the definition of terms departs from the commonly used meaning of the term, applicant intends to utilize the definitions provided below, unless specifically indicated.

It is to be understood that the foregoing general description and the following detailed description are exemplary and explanatory only and are not restrictive of any subject matter claimed. In this application, the use of the singular includes the plural unless specifically stated otherwise. It must be noted that, as used in the specification and the appended claims, the singular forms "a," "an" and "the" include plural referents unless the context clearly dictates otherwise. In this application, the use of "or" means "and/or" unless stated otherwise. Furthermore, use of the term "including" as well as other forms, such as "include", "includes," and "included," is not limiting.

For purposes of the present invention, the term "comprising," the term "having," the term "including," and variations of these words are intended to be open-ended and mean that there may be additional elements other than the listed elements.

For purposes of the present invention, directional terms such as "top," "bottom," "upper," "lower," "above," "below," "left," "right," "horizontal," "vertical," "up," "down," etc., are used merely for convenience in describing the various embodiments of the present invention. The embodiments of the present invention may be oriented in various ways. For example, the diagrams, apparatuses, etc., shown in the drawing figures may be flipped over, rotated by 90° in any direction, reversed, etc.

For purposes of the present invention, a value or property is "based" on a particular value, property, the satisfaction of a condition, or other factor, if that value is derived by performing a mathematical calculation or logical decision using that value, property or other factor.

For purposes of the present invention, it should be noted that to provide a more concise description, some of the quantitative expressions given herein are not qualified with the term "about." It is understood that whether the term "about" is used explicitly or not, every quantity given herein is meant to refer to the actual given value, and it is also meant to refer to the approximation to such given value that would reasonably be inferred based on the ordinary skill in the art, including approximations due to the experimental and/or measurement conditions for such given value.

Description

While the invention is susceptible to various modifications and alternative forms, specific embodiment thereof has been shown by way of example in the drawings and will be described in detail below. It should be understood, however that it is not intended to limit the invention to the particular forms disclosed, but on the contrary, the invention is to cover all modifications, equivalents, and alternatives falling within the spirit and the scope of the invention.

Systems and methods are provided to assist with creating a secure, robust, and reliable curtain rod assembly. The disclosed curtain rod assembly focuses on providing a simple, easy to use system of complementary components which provide a locking mechanism between the curtain rod and, e.g., an associated finial. Additional features and advantages of the invention will be set forth in the description which follows, and in part will be apparent from the description, or may be learned by practice of the invention. The objectives and other advantages of the invention will be realized and attained by the structure and particularly pointed out in the written description and claims hereof as well as the appended drawings.

Accordingly, the embodiments of the present invention are directed to systems and methods that integrate improved curtain rod assembly components that substantially obviate one or more problems due to limitations and disadvantages of related art.

To achieve these and other advantages and in accordance with the purpose of the present invention, as embodied and broadly described, the improved curtain rod assembly includes a system for assembling the curtain rod assembly utilizing complementary locking and key components which allow for a secure, robust, and reversible connection between a curtain rod and an associated finial. The embodiments of the present invention are generally directed towards systems and methods that provide for an improved curtain rod assembly featuring complementary locking components configured to actuate and interlock without a need for additional tools. The embodiments may include a biasing element to maintain a lock once the complementary elements are engaged. Further, additional advantages may be provided by allowing for a variety of finial designs to be added and removed from a curtain rod without damaging the curtain rod or finial with hardware as is required by conventional systems of curtain rod assemblies.

FIG. 1 illustrates an example of a conventional curtain rod assembly.

As shown in FIG. 1, one example of a conventional curtain rod assembly is illustrated as system 100. System 100 includes one end of a curtain rod 110, a finial 111, and a finial adapter assembly 112. End face 114 of curtain rod 110 may be configured to receive an end cap or cover 115. The cover 115 may be configured to receive a screw 116, either through a central hole provided in cover 115, or as the screw penetrates a solid cover 115. The screw 116 for securing the end cap may be a double-ended screw having a wood-screw thread on a first end 118 and a machine-screw thread on a second end 119 opposite the first end 118. The finial 111 may be connected to screw 116 by an adapter such as bushing 120, which may include an attachment point 121 for finial 111 to attach to bushing 120. Conventional curtain rod assemblies may also involve a screw oriented transverse to an axis 117 of the curtain rod 110, such that the screw goes through the curtain rod and a fitted end of a finial to secure the finial to the curtain rod.

Figure 2:
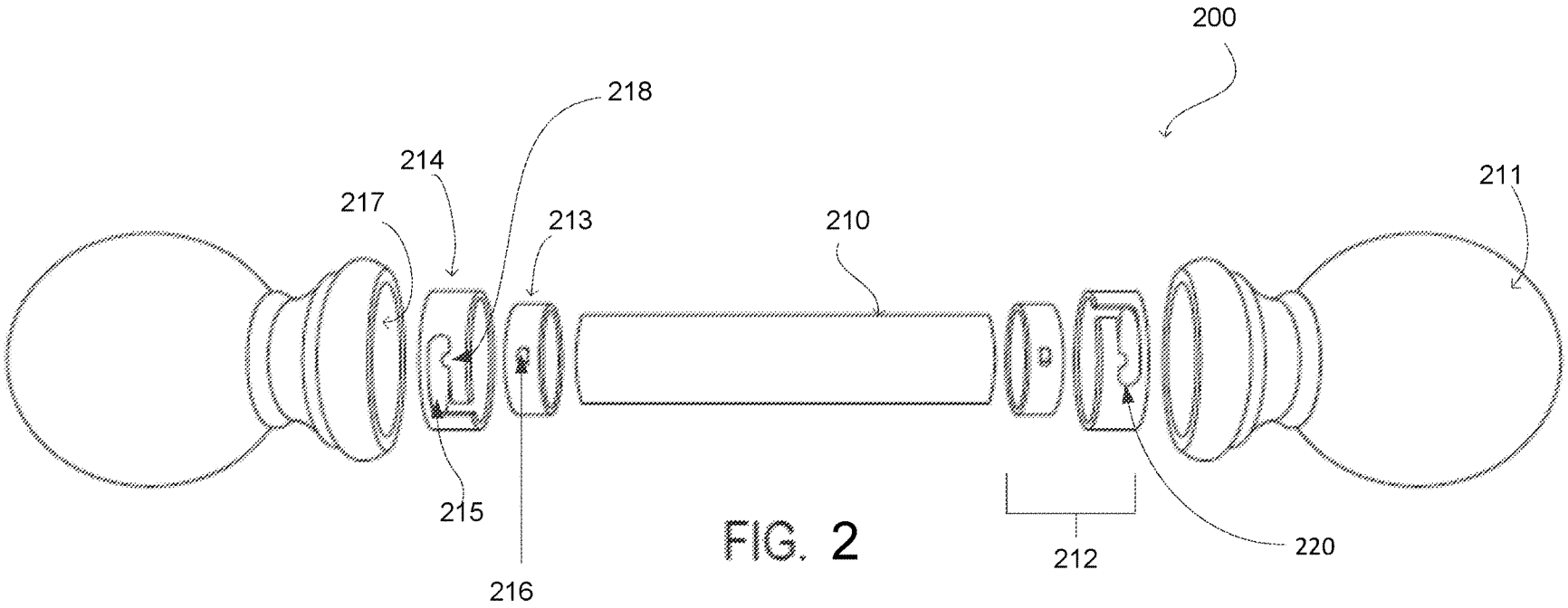
FIG. 2 illustrates a curtain rod assembly according to an example embodiment of the present invention.

FIG. 2 illustrates a curtain rod assembly according to an example embodiment of the present invention.

As shown in FIG. 2, an improved curtain rod assembly is illustrated as system 200. System 200 includes a curtain rod 210 and a desired finial 211. To attach the finial 211 with the curtain rod 210, system 200 includes a curtain rod end cap 213 and a complementary finial attachment component 214. A combination of end cap 213 and finial attachment component 214 may be considered a connection apparatus 212. In the example embodiment, end cap 213 may be configured with a key component 216, illustrated here as a raised tab. Finial attachment component 214 is designed to be complementary in shape to end cap 213. As embodied, finial attachment component 214 is illustrated with a locking component 215 configured and illustrated as an approximately L-shaped groove configured to be complementary to and accept the raised tab 216. As such, the embodiment is configured to have end cap 213 slide into finial attachment component 214, with finial attachment component 214 similarly being configured to slide into finial port 217. As illustrated, however, end cap 213 may only slide into finial attachment component 214 in a configuration where key component 216 is correctly paired with an opening corresponding to L-shaped groove 215. Otherwise, the key component 216 may prevent insertion of the end cap into finial attachment component 214. Once slid into place with the key component 216 in the correct alignment, the L-shaped groove 215 of the finial attachment component 214 may allow a user to twist finial 211 such that tab 216 moves circumferentially within L-shaped groove 215 until reaching the end 220 of the groove 215. The groove 215 may include a corresponding locking port 218. Locking port 218 serves to retain key component 216 in position such that after key component 216 has passed a location of locking port 218, end cap 213 and finial attachment component 214 may be considered to be stable and substantially secured together thereby achieving an assembled locked position.

Disassembly requires the user to disengage the key component 216 from the locking port 218 by counter rotating end cap 213 thereby urging key component 216 past locking port 218 along L-shaped groove 215. Continued rotation and manipulation of key component 216 removes key component 216 from L-shaped groove 215 thereby removing the end cap 213 from within the finial attachment component 214 in a disassembled unlocked position.

Similar to the relationship between end cap 213 and finial attachment component 214, there may be a complementary relationship between the finial attachment component 214 and finial port 217. For example, finial attachment component 214 and finial port 217 may share a complementary threaded relationship, a lock and key relationship, or optionally, finial attachment component 214 may be installed within port 217.

The key component 216 and complementary locking component 215 are illustrated as exemplary and non-limiting. In this and other embodiments presented herein, other equivalent complementary locking systems according to the spirit of the invention are envisioned. For example, a spiral or other shape may be utilized as the locking component 215. Moreover, instead of a simple raised tab, key component 216 may be configured as a hook, an L-shaped protrusion, or another shape capable of functioning as a key component. Similarly, any set of complementary shapes and structures such that key component 216 and locking component 215 are configured to engage and, ideally, lock.

Figure 3:
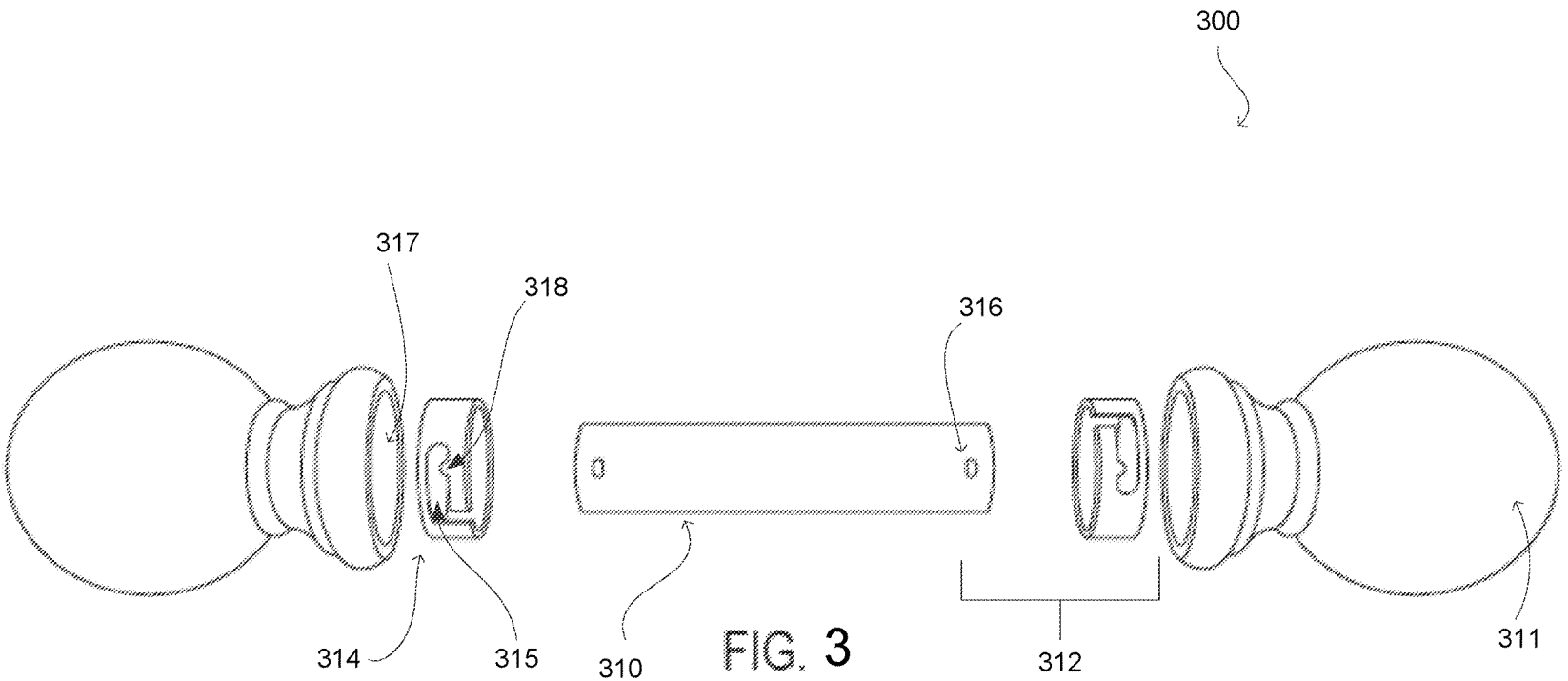
FIG. 3 illustrates a curtain rod assembly according to another example embodiment of the present invention.

FIG. 3 illustrates a curtain rod assembly according to another example embodiment of the present invention.

As shown in FIG. 3, an alternate embodiment of the curtain rod assembly is illustrated as system 300. System 300 includes a curtain rod 310, a finial 311, and a finial attachment component 314, a connector, which may be similar to finial attachment component 214 of FIG. 2. In this alternative embodiment, the curtain rod 310 is provided with a key component 316 configured as a raised tab. The connector 314, like the finial attachment component 214, is configured to be disposed between the curtain rod 310 and the finial 311. The connector 314 is configured to be complementary to both the finial 311 and the curtain rod 310 in shape and design, being configured to fit within finial port 317 and receive curtain rod 310. The connector 314 may be configured to engage and/or lock with the finial 311 in addition to engaging curtain rod 310. By placing the locking component 316 directly on the curtain rod, the embodiment illustrated in FIG. 3 obviates the need for a separate end cap like element 213 illustrated in FIG. 2. However, finial attachment component 314 may be configured with an approximately L-shaped groove 315 configured as a locking component. Locking component 315 may be configured to accept the raised tab 316 similar to FIG. 2 which combines the curtain rod 310 with connector 314 to form connection apparatus 312. Groove 315 may be configured with a corresponding locking port 318 designed and adapted to complement key component 316. Locking port 318 may be designed to interact with key component 316 in a similar fashion as described with respect to locking port 218 and key component 216, described in FIG. 2.

As discussed above regarding FIG. 2, the key component 316 and complementary locking component 315 are illustrated as exemplary and non-limiting. In this and other embodiments presented herein, other equivalent complementary locking systems according to the spirit of the invention are envisioned.

Figure 4:
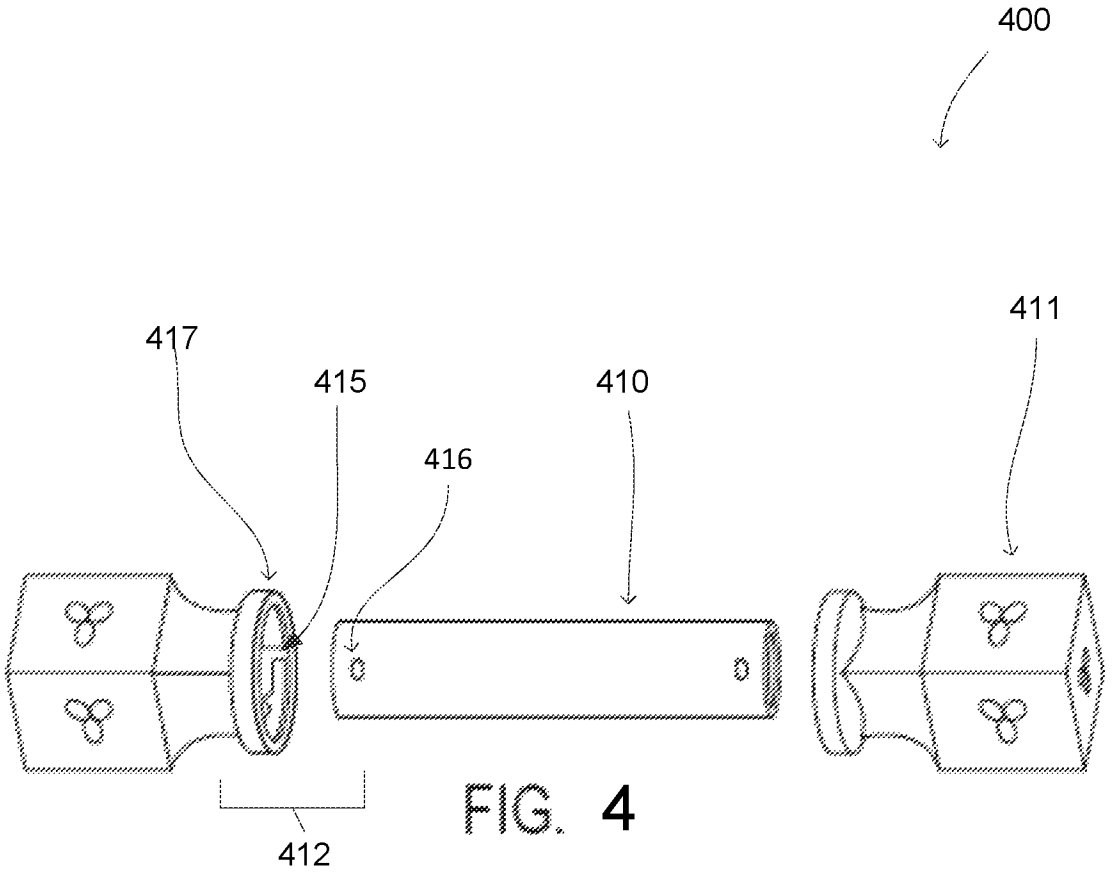
FIG. 4 illustrates a curtain rod assembly according to yet another example embodiment of the present invention.

FIG. 4 illustrates a curtain rod assembly according to yet another example embodiment of the present invention.

As shown in FIG. 4, a system 400 may include a curtain rod 410 and a finial 411. Curtain rod 410 may be configured to have a key component 416, which may be a raised tab or other similar element. Finial 411 may be configured with a finial port 417 configured as an opening to accept an end of curtain rod 410. In an alternative embodiment, finial port 417 is configured to include locking component 415 as an integral aspect of the finial port 417 such that finial 411 and curtain rod 410 may be combined into a connection apparatus 412. In fabricating the finial 411, the body of finial 411 may be embodied as a solid structure or a hollow structure in addition to having port 417 at an end. Further, the locking component 415 may be arranged within finial port 417 close to the aperture as illustrated. In an alternative embodiment, the locking component 415 may be arranged deep within the finial body 411 such as when the finial is configured as a hollow structure. The embodiment including a hollow finial body 411 may be hollow in the sense of a passage in which curtain rod 410 may enter, or the finial body 411 may be a hollow shell structure. Locking component 415 may be designed as a notch or groove or other suitable structure, with a preferred embodiment designed as an L-shaped groove, as illustrated. System 400 may also include a locking port similar to locking port 218 that may interact with key component 416 similarly to the system described in FIG. 2, such that a locked assembly position may be achieved.

Figure 5:
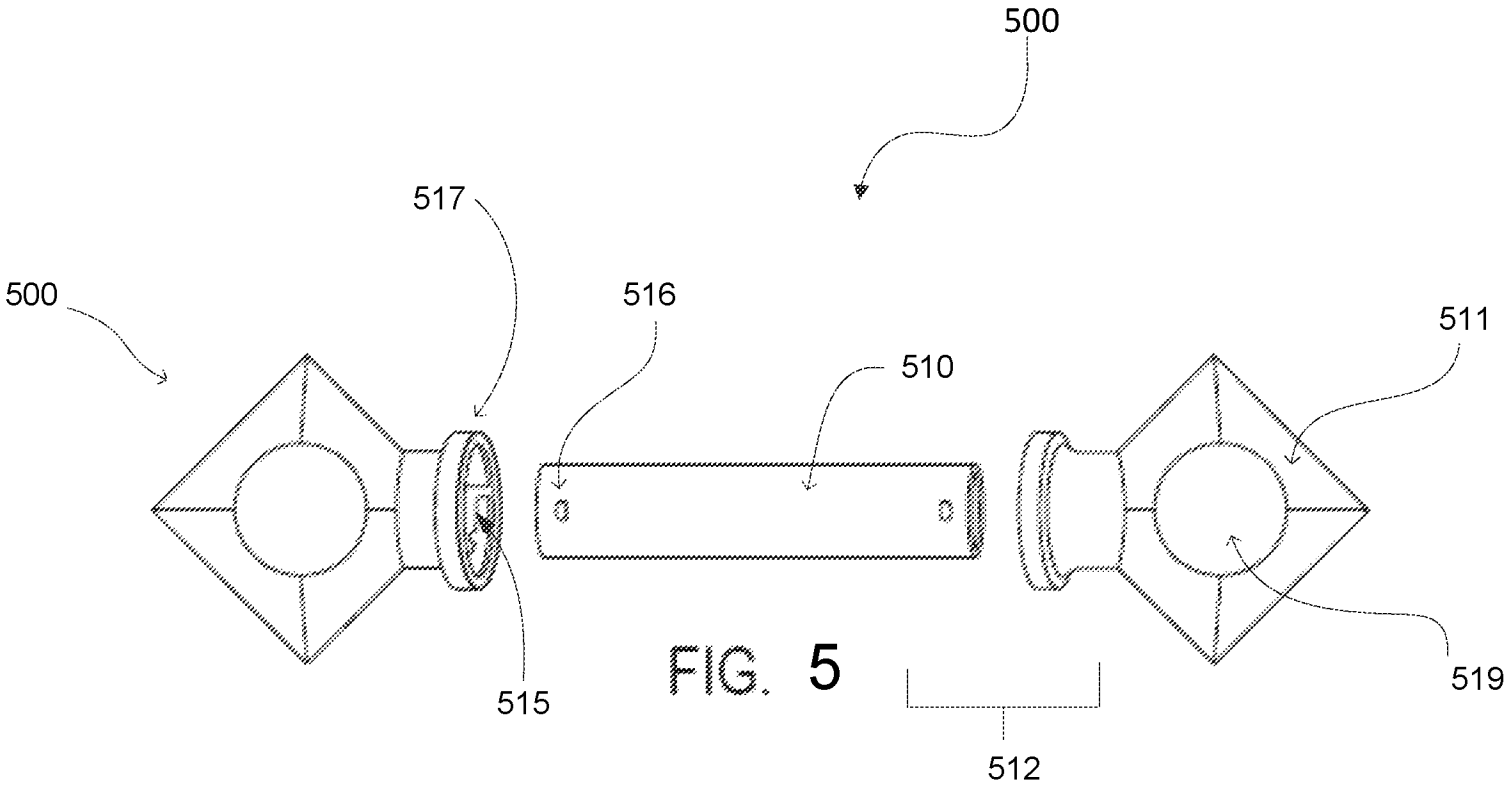
FIG. 5 illustrates a curtain rod assembly according to yet another example embodiment of the present invention.

FIG. 5 illustrates a curtain rod assembly according to yet another example embodiment of the present invention.

In FIG. 5, a system 500 is illustrated as having a curtain rod 510 and a finial 511 having a finial body 511. In the embodiment illustrated in FIG. 5, finial body 511 is arranged as a solid structure with a central aperture 519, which may be ornamental in design. In FIG. 5, curtain rod 510 is configured with a key component 516 and finial 511 includes a locking component 515 arranged within finial port 517 such that finial 511 and curtain rod 510 may be combined into a connection apparatus 512. In the embodiment illustrated in FIG. 5, curtain rod 510 may be inserted directly into finial port 517 with key component 516 aligned appropriately with locking component 515, locking component 515 having a complementary configuration such that key component 516 may be considered as a guide for the curtain rod 510 to be inserted into finial 511. Locking component 516 may be configured as a notch or groove, illustrated as an L-shaped groove in FIG. 5, with the L-shape being exemplary and non-limiting. System 500 may also include a locking port similar to locking port 218 that may interact with key component 516 similarly to the system described in FIG. 2, such that a locked assembly position may be achieved. Aperture 519 may be ornamental or may be functional, such as providing the user with a location from which to apply torque to the finial 511 or curtain rod assembly 500.

Figure 6:
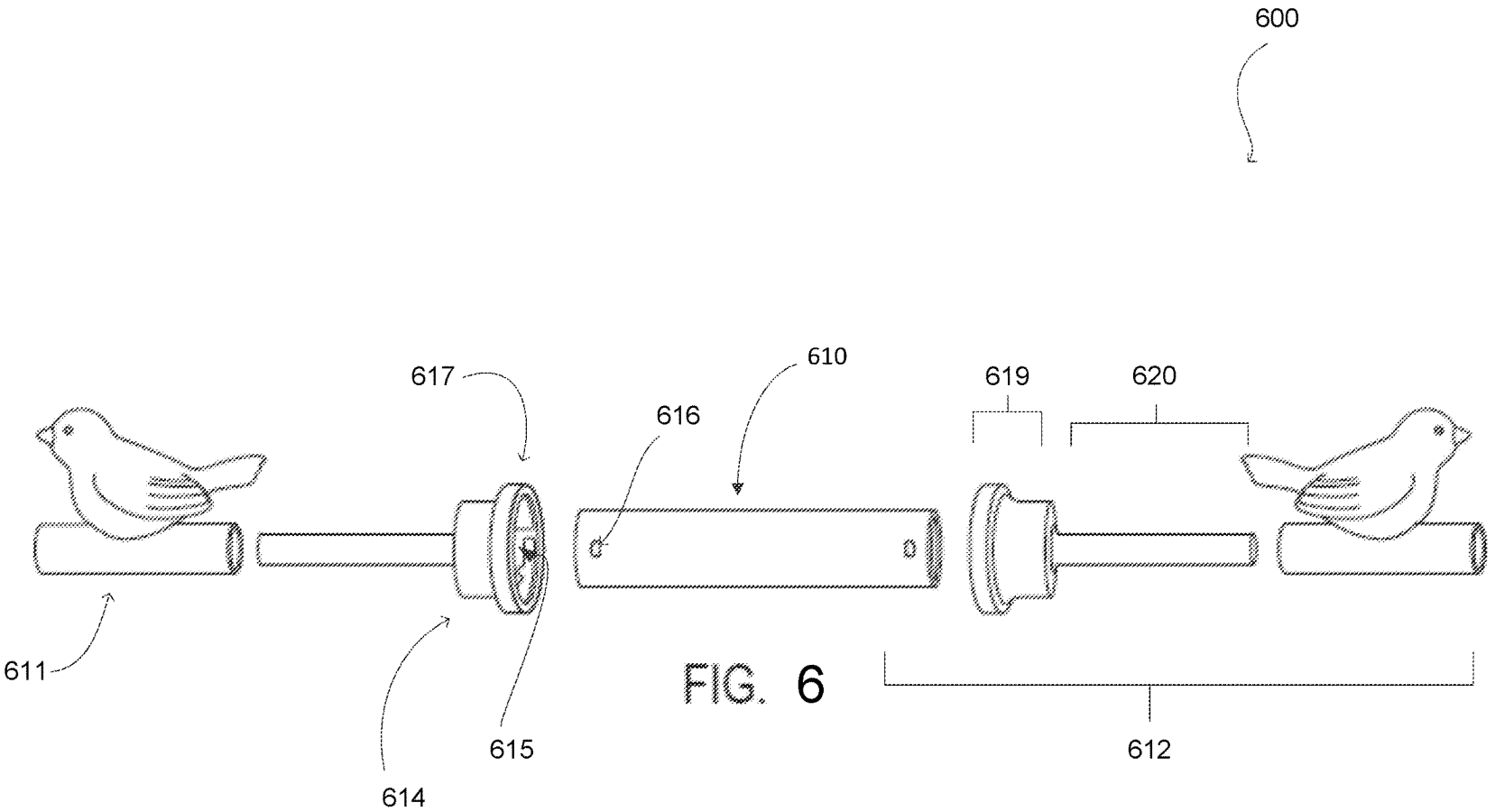
FIG. 6 illustrates a curtain rod finial according to an example embodiment of the present invention.

FIG. 6 illustrates a curtain rod assembly according to yet another example embodiment of the present invention.

As illustrated in FIG. 6, system 600 may include a curtain rod 610, a finial 611, and a finial attachment component 614, a connector which may have similar aspects to finial attachment component 214. In the exemplary embodiment illustrated in FIG. 6, curtain rod 610 may be configured with a key component 616 and finial attachment component 614 may be configured with an attachment port 617 into which the curtain rod may be inserted subject to alignment between the key component 616 and a locking component 615 arranged within the finial attachment component 614. In turn, the finial attachment component 614 may be configured to fit snugly within the finial 611 as the finial attachment component 614 may be configured to be complementary to the shape of the finial 611. As such, curtain rod 610 may be combined with finial attachment component 614 via key component 616 to form connection apparatus 612. To accomplish the intended goal of serving as a connection component between the curtain rod 610 and the finial 611, the finial attachment component 614 may be configured as having a first section 619 including the connector port 617 and locking component 615 and a second section 620 configured to match and be complementary to the finial 611. For example, section 620 may comprise a long tube complementary to a hollow interior body shape within finial 611. The finial 611 may be configured to include a decorative or ornamental aspect as illustrated. Like previous embodiments, the key component 616 and the locking component 615 are configured to engage one another such that correctly aligning and maneuvering the finial attachment component 614 will allow full engagement between the curtain rod 610 and the finial 611. System 600 may also include a locking port similar to locking port 218 that may interact with key component 616 similarly to the system described in FIG. 2, such that a locked assembly position may be achieved.

Figure 7:
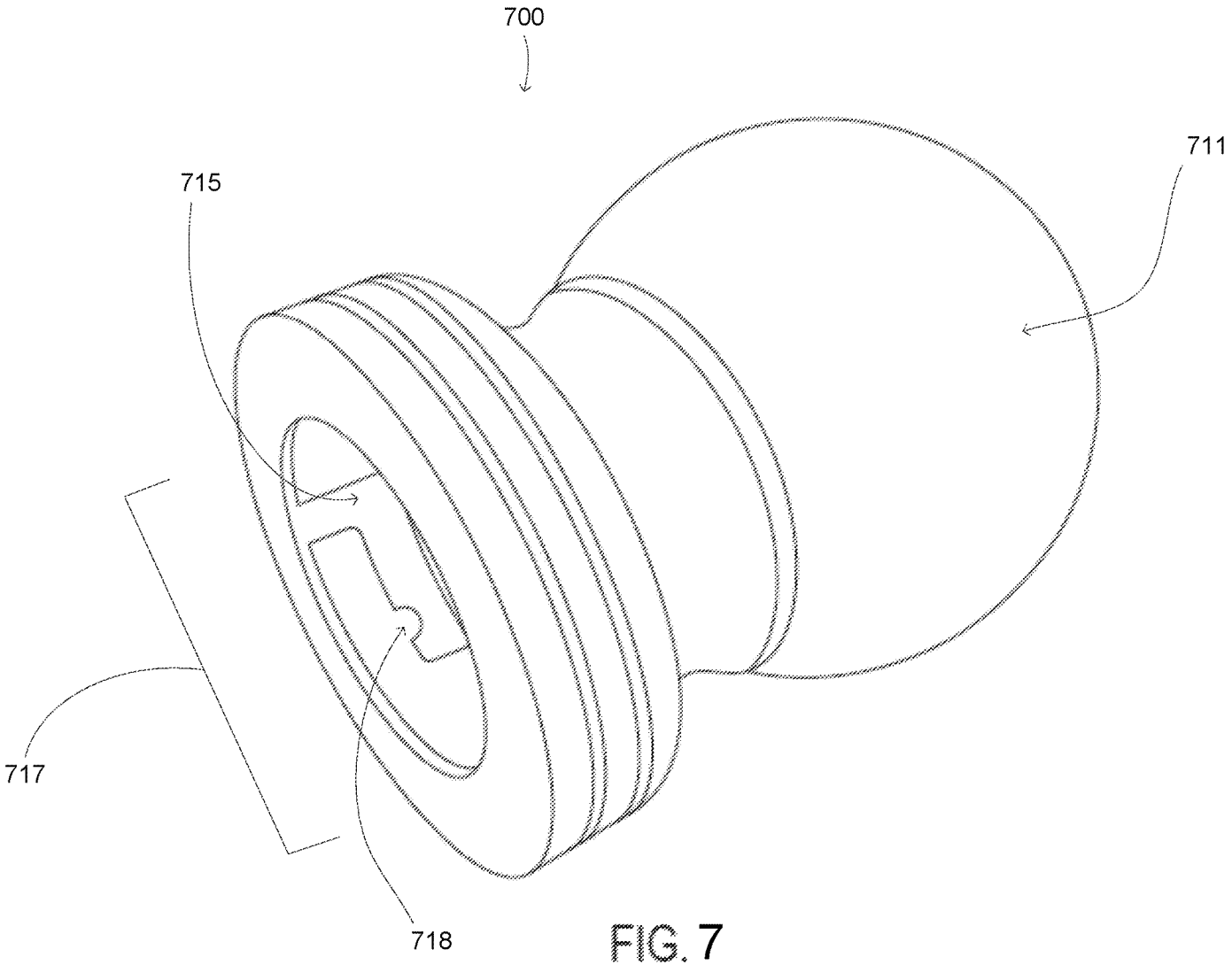
FIG. 7 illustrates a curtain rod assembly according to yet another example embodiment of the present invention.

FIG. 7 illustrates a curtain rod finial according to an example embodiment of the present invention.

FIG. 7 provides an illustrated enlarged view of a curtain rod finial according to an exemplary embodiment. A locking component 715 is disposed within a finial port 717 of finial 711. In this embodiment, locking component 715 is configured with locking port 718 such that engagement with a key component (not shown) may be fastened securely. Such a key component may be arranged to function similarly to the systems 200, 300, 400, 500, 600. As discussed previously, finial 711 may be configured as a solid structure which is filled or a hollow structure allowing deeper insertion of the curtain rod. A hollow structure, with the increased depth aspect, may be configured with a more complicated or longer locking component 715 to provide added security and stability.

Figure 8:
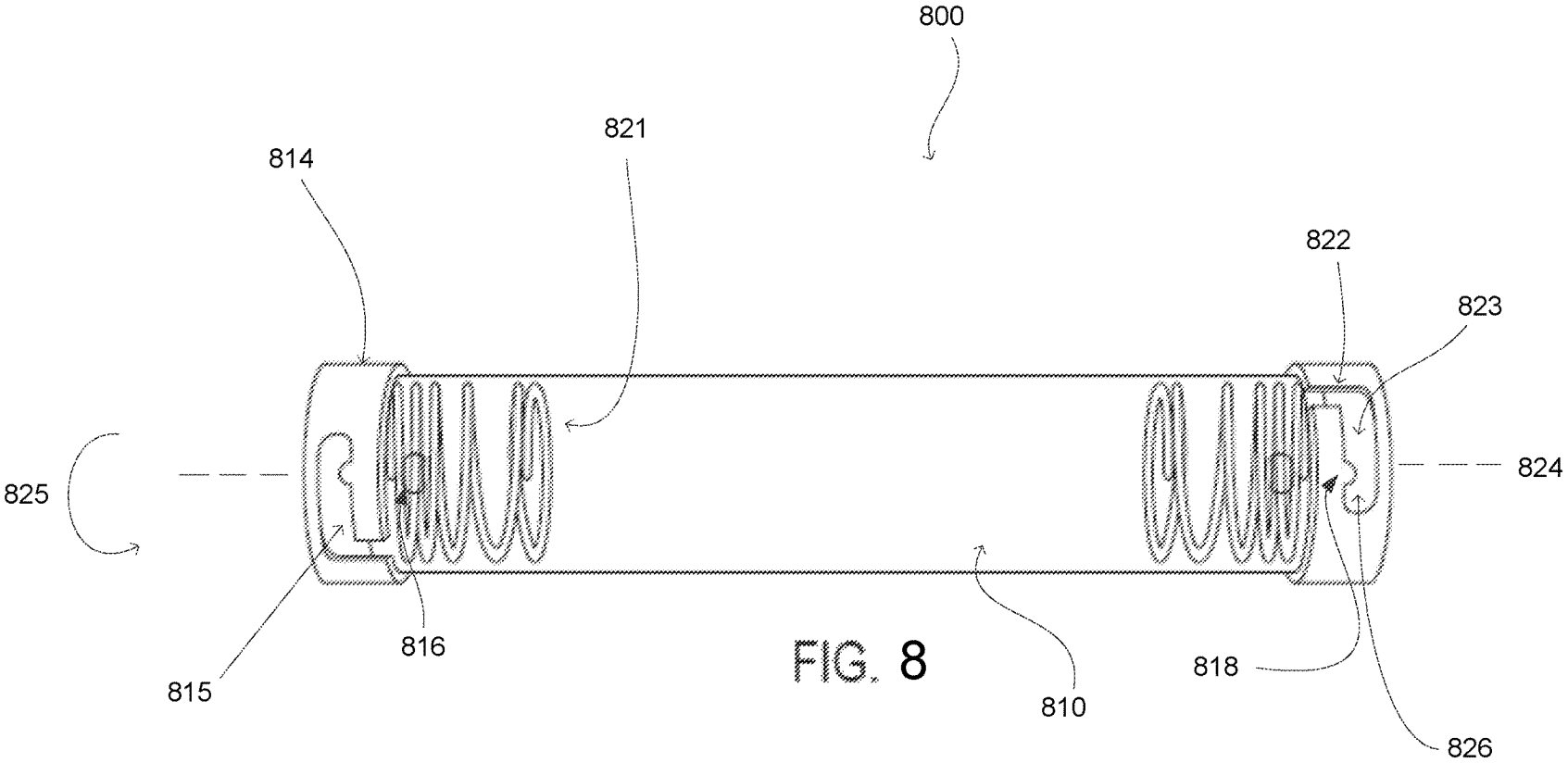
FIG. 8 illustrates a curtain rod assembly according to yet another example embodiment of the present invention.

FIG. 8 illustrates a curtain rod assembly according to yet another example embodiment of the present invention.

As illustrated in FIG. 8, a system 800 illustrates a curtain rod 810 which may be provided with key component 816, exemplarily embodied herein as a raised tab. Finial attachment component 814, a connector, is provided with a locking component 815 configured to be complementary to key component 816. As illustrated, locking component 815 may include locking port 818 as an additional feature to ensure secure fit between curtain rod 810 and finial attachment component 814. Finial attachment component 814 may be placed on the end of curtain rod 810, but must ensure alignment between locking component 815, illustrated here as an L-shaped groove, and key component 816. As illustrated, correct alignment would be achieved by the short leg 822 of the L-shaped groove being aligned with key component 816 as finial attachment component 814 is moved laterally, that is along an axis 824 of the curtain rod 810. Correct engagement would then be possible by turning finial attachment component 814 circumferentially, illustrated as 825, such that the key component slides circumferentially up into the long leg 823 of the L-shaped groove 815. As illustrated in system 800, curtain rod 810 may also be provided with a biasing element 821, illustrated herein as a spring, which may then be relied upon to ensure that key element 816 resides behind locking port 818 in an engaged and assembled configuration, e.g., at location 826. System 800 may also include a locking port similar to locking port 218 that may interact with key component 816 similarly to the system described in FIG. 2, such that a locked assembly position may be achieved.

Thus, as illustrated, the embodiments described herein overcome many of the problems facing current curtain rod assemblies and users limited thereby. In particular, the lack of screws or other sharp objects which may injure the user is an instant benefit both in the reduced risk of injury to the user as well as the increased robustness of the system, as installation, changing, or removal of the curtain rod assembly does not rely on screws, etc., that may become stripped, bent, or otherwise ineffective over time.

According to the various embodiments, the curtain rod, curtain rod cap, tension ring, finial, and/or other components may be made of a variety of suitable materials (e.g., wood, plastic, various metals, etc.). In addition, the curtain rod assemblies described herein may take on numerous shapes and sizes depending on their intended application (e.g., size and shape of window, curtain weight, etc.). For example, common curtain rod diameters may include about 1", 1¼", 1½", and 1¾".

The curtain rod cap may be made out of a variety of materials. In some instances, a strong plastic type material may be preferred. In addition, it may be configured to fit over or plug the corresponding curtain rod. The curtain rod cap may include one or more round and/or flat circular notches or locking tips. In some embodiments, the curtain rod cap may be affixed to the curtain rod with a strong adhesive or tension spring. Alternatively, the locking tips may be integrally formed as part of the curtain rod.

The tension ring may be composed of a variety of materials. In some instances, a strong plastic type material may be preferred. Within the tension ring, an "L-shaped" groove may be formed along an inner surface. For example, the L-shaped groove may traverse approximately or about ¼ the diameter of the tension ring. The L-shaped grove may also include a locking bump that is configured to engage with the locking tip described above. When engaged, the locking tip and locking bump may snap together.

The finial may incorporate numerous aesthetic designs. For example, the finial may include an open end configured to receive the tension ring. Here, the tension ring may snap into the hallow area, or otherwise be affixed to the finial. In some instances, the L-shaped groove discussed above may be integrally formed within an inner surface of the finial.

The embodiments described herein are especially advantageous because they can be used in combination with already existing curtain rods. The curtain rod cap, tension ring, and finials described herein can be affixed to any curtain rod. In addition, the components may be precast.

It will be apparent to those skilled in the art that various modifications and variations can be made in the curtain rod assembly of the present invention without departing from the spirit or scope of the invention. Thus, it is intended that the present invention cover the modifications and variations of this invention provided they come within the scope of the appended claims and their equivalents.

The invention claimed is:

1. A curtain rod assembly, comprising:

a curtain rod;

a finial;

a key component arranged on an end cap configured to slide onto an end of the curtain rod; and a locking component arranged on a connector configured to slide onto the end cap;

wherein the key component is associated with one of the curtain rod and the finial and the locking component is associated with the other of the curtain rod and the finial, the key component is configured to be complementary to the locking component, and the key component and the locking component are configured to engage to provide a secure but reversible fit when the key component engages the locking component and is rotated circumferentially wherein the curtain rod include a biasing element configured to provide a force to maintain a secure connection between the key component and the locking component.

2. The curtain rod assembly according to claim 1, wherein the locking component is arranged on a connector configured to be placed between the finial and the curtain rod.

3. The curtain rod assembly according to claim 1, wherein the connector is configured to combine with the end cap only when the key component is correctly aligned with the locking component.

4. The curtain rod assembly according to claim 1, wherein the finial includes a port into which the curtain rod may enter the finial.

5. The curtain rod assembly according to claim 1, wherein the locking component comprises a groove.

6. The curtain rod assembly according to claim 1, wherein the key component comprises a raised tab.

7. The curtain rod assembly according to claim 5, wherein the key component comprises a raised tab.

8. The curtain rod assembly according to claim 5, wherein the groove is arranged within the finial.

9. The curtain rod assembly according to claim 1, wherein the key component is arranged as a protrusion from the curtain rod.

10. The curtain rod assembly according to claim 5, wherein the groove is configured to include a locking port with which the key component engages when the key component and locking component are securely interlocked.

11. A method for assembling a curtain rod assembly, comprising:

aligning a curtain rod with a complementary finial;

arranging a locking component in a location that will be overlapped by both a curtain rod and a finial in an assembled configuration of the curtain rod assembly;

wherein the locking component is arranged on a connector configured to slide onto an end cap positioning a key component in a location that will be overlapped by both the curtain rod and the finial in an assembled configuration of the curtain rod assembly, the key component being complementary to the locking component wherein the key component is arranged on the end cap configured to slide onto an end of the curtain rod;

aligning the key component with the locking component prior to combining the curtain rod with the finial;

pushing together the curtain rod and the finial such that the key component engages the complementary locking component; and adjusting the finial and curtain rod such that the key component rotates circumferentially relative to the locking component as the curtain rod and the finial are combined into the curtain rod assembly and the key component provides a secure connection wherein the curtain rod includes a biasing element configured to provide a force to maintain a secure connection between the key component and the locking component.

* * * * *